US005647772A

United States Patent [19]

Martucci et al.

[11] Patent Number: 5,647,772

[45] Date of Patent: Jul. 15, 1997

[54] TERMINAL POSITION ASSURANCE SYSTEM FOR AN ELECTRICAL CONNECTOR

[75] Inventors: Roberto Martucci, Montegrotto T. Padova; Gianni Zuin, Mestrino-Padova, both of Italy

[73] Assignee: Molex Incorporated, Lisle, Ill.

[21] Appl. No.: 633,282

[22] Filed: Apr. 16, 1996

[30] Foreign Application Priority Data

May 31, 1995 [EP] European Pat. Off. ..... 95108287

[51] Int. Cl.[6] ..... H01R 13/428

[52] U.S. Cl. ..... 439/748

[58] Field of Search ..... 439/746, 747, 439/748, 749, 752

[56] References Cited

U.S. PATENT DOCUMENTS

| | | | |
|---|---|---|---|
| 3,212,052 | 10/1965 | Johanson | 439/748 |
| 4,544,220 | 10/1985 | Aiello et al. | 439/748 |
| 4,557,542 | 12/1985 | Coller et al. | 339/59 M |
| 4,565,416 | 1/1986 | Rudy et al. | 439/748 |
| 4,787,864 | 11/1988 | Hunt, III et al. | 439/595 |
| 4,820,198 | 4/1989 | Lulko et al. | 439/595 |
| 4,932,899 | 6/1990 | Sueyoshi et al. | 439/595 |
| 4,944,695 | 7/1990 | Tsuji et al. | 439/595 |
| 4,944,696 | 7/1990 | Sueyoshi et al. | 439/595 |
| 4,975,082 | 12/1990 | Nagasaka et al. | 439/595 |
| 5,085,599 | 2/1992 | Maejima et al. | 439/595 |
| 5,127,854 | 7/1992 | Fujitani et al. | 439/595 |
| 5,295,846 | 3/1994 | Sumida et al. | 439/188 |

FOREIGN PATENT DOCUMENTS

| | | | |
|---|---|---|---|
| 0147956B1 | 2/1991 | European Pat. Off. | H01R 13/424 |
| 0600469A1 | 6/1994 | European Pat. Off. | H01R 13/436 |

*Primary Examiner*—Gary F. Paumen
*Assistant Examiner*—Christopher Goins
*Attorney, Agent, or Firm*—Stacey E. Caldwell

[57] ABSTRACT

A terminal position assurance (TPA) system for an electrical connector which includes a dielectric housing having terminal-receiving passageways with latch shoulders formed therein. A terminal is insertable into a rear end of the passageway and includes an outwardly extending primary locking portion adapted to latch behind latch shoulders of the passageway. A TPA device is engageable with a forward mating end of the housing and includes a secondary locking portion insertable into a front end of the passageway to prevent unlatching of the primary locking portion from the latch shoulders. If the terminal is incompletely inserted into the passageway, the secondary locking portion of the TPA device comes in contact with the primary locking portion of the terminal to move the terminal rearwardly and therefore detects incomplete insertion of the terminals.

15 Claims, 3 Drawing Sheets

TERMINAL POSITION ASSURANCE SYSTEM FOR AN ELECTRICAL CONNECTOR

FIELD OF THE INVENTION

This invention generally relates to the art of electrical connectors and, particularly, to an electrical connector which incorporates an improved terminal position assurance (TPA) system.

BACKGROUND OF THE INVENTION

Generally, an electrical connector includes a dielectric housing mounting electrically conductive terminals therein. The terminals are electrically connected to other circuit components, such as discrete wires. Connectors often are employed in mateable pairs such that each terminal and the housing of one connector are mateable with a corresponding terminal and the housing of another connector.

A poor quality electrical connection may occur if one or more terminals are not properly seated in their respective housing. The improper seating of a terminal in a housing may occur due to a variety of reasons, such as if the terminal is not completely inserted into the housing during the initial assembly of the connector or if the terminal is vibrated or pulled out of its fully seated condition during use of the connector. To avoid these problems, various connectors have been provided with some form of a terminal position assurance (TPA) system to detect incomplete insertion of the terminals.

In some applications, a primary locking means such as locking arms on the terminal or housing locks the terminals in the housing, and a TPA system or device may function as a secondary locking means. A TPA device may therefore include projections insertable into terminal-receiving passages of a connector housing to block movement of the primary locking arms away from a locked position. If a terminal is not fully inserted, the primary locking arm may also prevent insertion or locking of the TPA device to thereby indicate a condition of incomplete insertion of the particular terminal. However, if the TPA device detects that one or more terminals are not fully inserted or seated, a search is required to isolate and identify the incompletely inserted terminal(s). This can be a time consuming operation and adds to the cost of the connector assembly operation. The present invention is directed to providing a TPA system or device which not only acts as a secondary locking means, but also detects an incompletely inserted terminal and moves the incompletely inserted terminal to an inoperative and detectable position.

SUMMARY OF THE INVENTION

An object, therefore, of the invention is to provide a new and improved terminal position assurance (TPA) system of the character described.

In the exemplary embodiment of the invention, a terminal position assurance (TPA) system is provided for an electrical connector. The connector includes a dielectric housing having a forward mating end and a rearward terminating end and terminal-receiving passageways extending between the ends. A latching section with an enlarged latch shoulder is formed in the passageway near the forward mating end of the housing. A terminal is insertable into the passageway from the rearward terminating end of the housing. The terminal has a mating portion adapted to mate with a complementary terminal of a mateable connecting device.

An outwardly extending primary locking portion of the terminal is adapted to latch behind the latch shoulder of the passageway. A TPA device is engageable with the housing at the forward mating end thereof. The TPA device includes a secondary locking portion positionable within the primary locking portion of the terminal to prevent the unlatching of the primary locking portion from the latch shoulder.

The TPA device further includes a passage therethrough in alignment with the passageway in the housing for insertion therethrough of the complementary terminal of the mateable connecting device. In addition, complementary interengaging preloading latches are provided between the TPA device and the housing for mounting the TPA device on the housing for movement between a first position allowing the latching of the primary locking portion with the latch shoulder and a second position preventing the unlatching of the primary locking portion from the latch shoulder.

In a preferred embodiment of the invention, the primary locking portion of the terminal projects beyond the forward mating end of the housing to provide access to the primary locking portion for unlatching and removing the terminal. The passages of the TPA device include an enlarged section for receiving the projecting primary locking portion. In addition, the mating portion of the terminal includes a longitudinal seam having a primary locking portion on each side of the seam, thereby providing transverse flexibility between the primary locking portions. The secondary locking portion of the TPA device is sized and configured for being received between the primary locking portions of the terminal to prevent transverse flexing thereof.

Lastly, the primary locking portion of the terminal is transversely movable between a first fully inserted position latched behind or in engagement with the latch shoulder of the passageway in the housing, and a second position of incomplete insertion of the terminal. The invention contemplates that the secondary locking portion of the TPA device be adapted to come in contact with the primary locking portion of the terminal in its second position to move the terminal rearwardly and detect incomplete insertion of the terminal. In fact, the terminal may be driven sufficiently rearwardly so that it not only cannot mate with the complementary terminal of the mateable connecting device but may be removed from the rearward terminating end of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
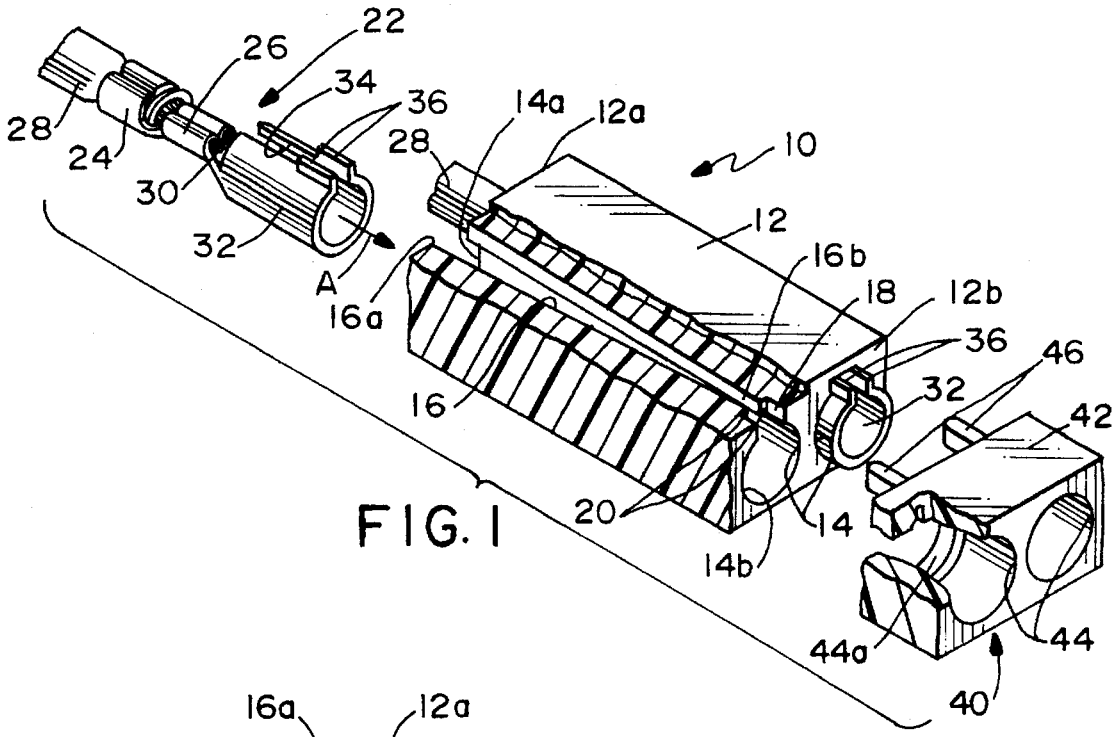
FIG. 1 is a fragmented perspective view, partially cutaway, of an electrical connector with one of two terminals fully received in the connector housing and the other terminal about to be inserted into the housing, and incorporating the TPA device of the invention.

Referring to the drawings in greater detail, and first to FIG. 1, the invention is embodied in an electrical connector, generally designated 10, which includes a dielectric housing 12 defining a plurality of elongated terminal-receiving passageways 14. Two terminal-receiving passageways 14 are shown in the portion of housing 12 in FIG. 1, but any number of such passageways can be formed in the dielectric housing in substantially any array thereof. Each passageway includes an entry end 14*a* opening through a rear terminating face 12*a* of housing 12, and a latch end 14*b* opening through a forward mating face 12*b* of the housing.

An elongated groove 16 communicates with each passageway 14 along the length thereof. The groove diverges gradually from a wide mouth end 16*a* adjacent entry end 14*a* of the respective passageway, to a narrow latch end 16*b* adjacent latch end 14*b* of the respective passageway. Latch end 16*b* of each groove 16 has an abruptly enlarged latch section 18 which defines a latch shoulder 20 on each opposite side of the groove at narrow latch end 16*b* of the groove.

A plurality of terminals, generally designated 22, are insertable into passageways 14 in the direction of arrow "A" (FIG. 1). Each terminal 22 includes two pairs of crimp arms 24 and 26 for terminating an electrical cable or wire 28. The pair of crimp arms 24 are adapted for crimping onto the outer cladding or covering of the cable to provide strain relief therefore. The pair of crimp arms 26 are adapted for crimping onto the conductive core 30 of the cable to establish conductivity between the terminal and the core. Although not shown in the drawings, the terminals could similarly be adapted for mounting to a printed circuit board instead of crimping to a wire.

Each terminal 22 is stamped and formed from conductive material and includes a generally cylindrical female mating portion 32 with an open seam 34 lengthwise thereof. The seam is established during the forming of the terminal. A primary locking portion or latch flange 36 extends transversely or radially outwardly from mating portion 32 on each side of the seam. The latch flanges are flexible relative to one another due to their location on opposite sides of the seam, i.e., the cylindrical mating portion can compress and expand due to the open seam.

In assembly and as stated above, each terminal 32, along with its crimped cable 28, is inserted into its respective passageway 14 in housing 12 in the direction of arrow "A" (FIG. 1). As the terminal is inserted into the passageway, outwardly extending latch flanges 36 project into and move longitudinally of diverging groove 16. As the terminal moves toward its fully inserted position, latch flanges 36 engage the opposite side walls of groove 16 causing the latch flanges to move toward each other, compressing mating portion 32, as the diverging groove gets narrower toward latch end 16*b* of the groove. When latch flanges 36 clear latch shoulders 20 at the latch end of the groove, the latch flanges will "snap" out behind the latch shoulders and prevent removal of the terminal opposite the direction of arrow "A".

Figure 2:
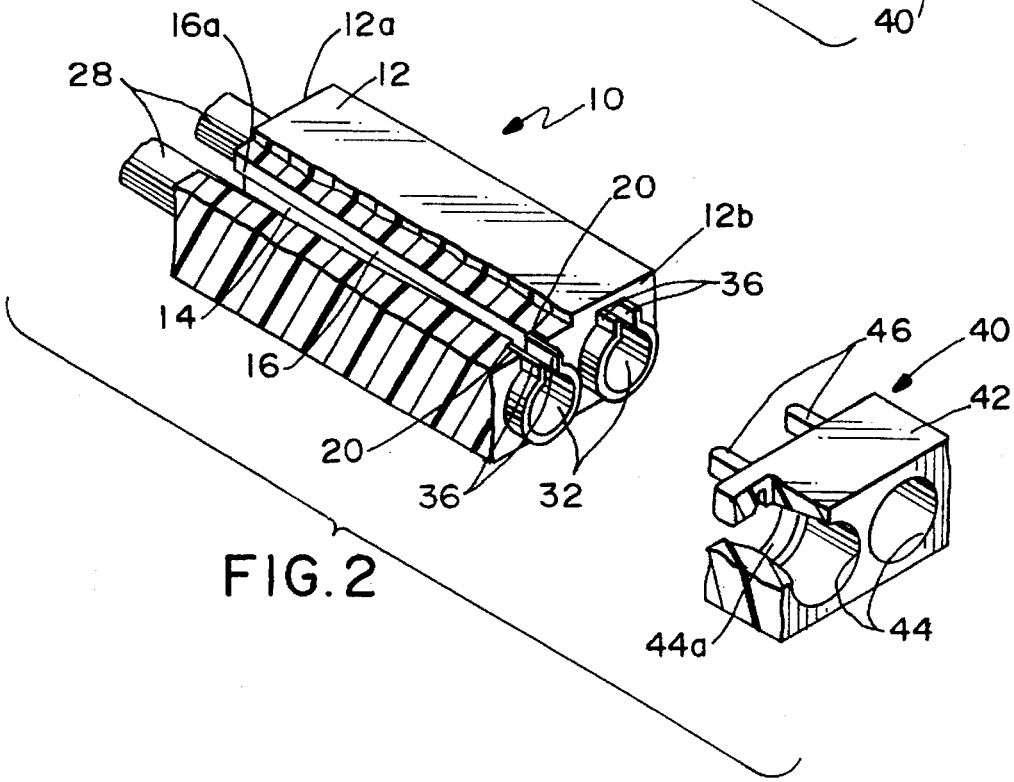
FIG. 2 is a view similar to that of FIG. 1, but with both terminals fully inserted into the housing.

FIG. 2 shows both terminals in their fully inserted positions, and it can be seen clearly how the latch flanges 36 of the left-hand terminal are latchingly positioned behind latch shoulders 20. It also can be seen in FIG. 2 that mating portions 32 and latch flanges 36 project beyond mating face 12*b* of housing 12. Therefore, a tool, such as a pliers, can be used to grasp latch flanges 36 and squeeze the latch flanges together so that the latch flanges can clear latch shoulders 20. When the latch flanges clear the latch shoulders, the respective terminal can be pulled out of its respective passageway 14 opposite the direction of insertion thereof (i.e., opposite the direction of arrow "A" in FIG. 1).

The invention contemplates a terminal position assurance (TPA) system for electrical connector 10 including a TPA device, generally designated 40, adapted for mounting to the forward mating face 12*b* of connector housing 12. The TPA device is very simple and inexpensive and includes a dielectric housing 42 having a plurality of passages 44 therethrough. The passages are alignable with passageways 14 in connector housing 12 when the TPA device is mounted on the connector housing. Passages 44 receive therethrough complementary terminals of a mateable connecting device so that the complementary terminals pass through the TPA device for engaging terminals 22 of connector 10. Each passage 44 through housing 42 of the TPA device includes an enlarged section 44*a* for receiving the forwardly projecting end 32 of the respective terminal 22, i.e. the end of the terminal that projects beyond forward mating face 12*b* of connector housing 12.

Figure 3:
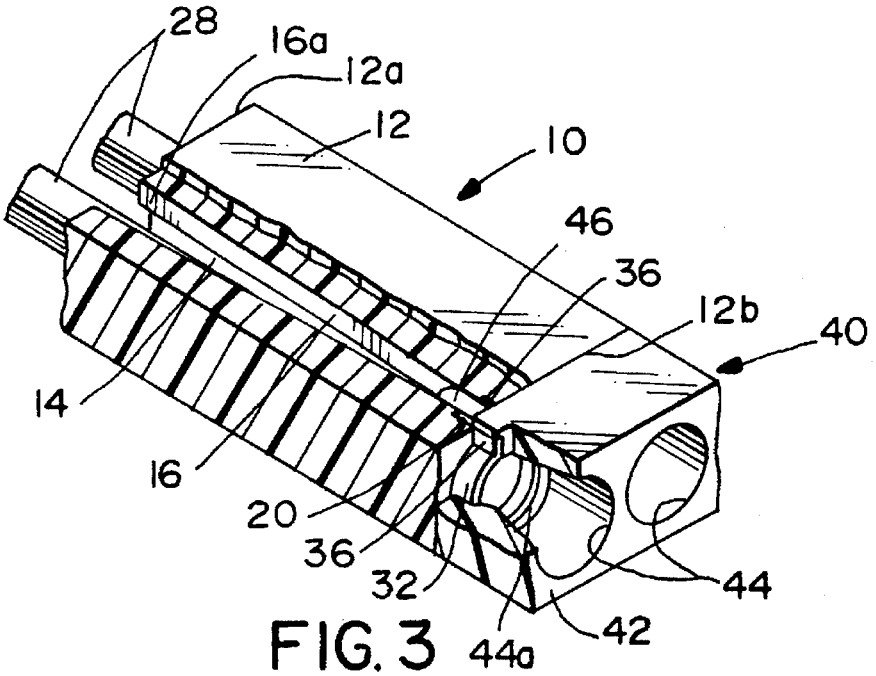
FIG. 3 is a view similar to that of FIG. 1, but with the TPA device fully mounted on the housing.

Referring to FIG. 3, when all of terminals 22 are fully inserted into connector housing 12, TPA device 40 can be fully mounted onto the housing such that a secondary locking portion 46 adjacent each passage 44 is insertable between the primary locking portions or latch flanges 36 of the respective terminal. Therefore, projections 46 act as secondary locking means to prevent latch flanges 36 from unlatching behind latch shoulders 20 at the forward ends of grooves 16. In essence, projections 46 of the TPA device block any transverse movement of the latch flanges toward each other, thereby solidly locking the terminals in their fully inserted positions. If any one terminal is not fully inserted, the respective projection 46 will push the incompletely inserted terminal rearwardly as will be seen hereinafter in reference to FIG. 5, to indicate that the terminal is not fully inserted.

Figure 4:
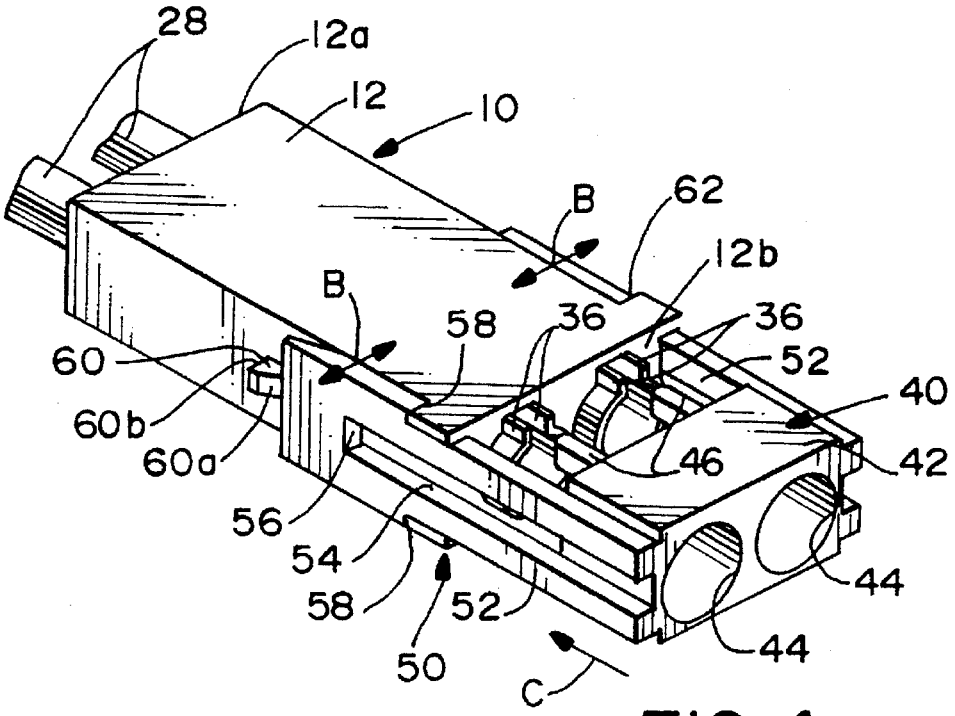
FIG. 4 is a perspective view of an electrical connector which houses two terminals and shows the preloading mounting means of the TPA device.

FIG. 4 shows complementary interengaging preloaded latches, generally designated 50, between TPA device 40 and connector housing 12. Generally, the latches mount the TPA device on the housing for movement between a first position shown in FIG. 4 allowing the latching of latch flanges 36 behind the latch shoulders of the terminal-receiving passageways, and a second position shown in FIG. 3 preventing the unlatching of the latch flanges from behind the latch shoulders.

More particularly, FIG. 4 shows a connector for mounting two terminals in order to facilitate an illustration of the complementary interengaging preloaded latches 50. Specifically, a pair of latch arms 52 project from TPA device 40 toward connector housing 12, with each latch arm including a groove 54 terminating in an interior latch shoulder 56. Exterior latch shoulders 58 are formed on the outside edges of each latch arm 52. A latch boss 60 is formed integral with connector housing 12 and projects outwardly from each side thereof. Each latch boss has a chamfered forward end 60*a* and an abrupt rear end 60*b* forming a latch shoulder. The connector housing also has latch shoulders 62 near forward mating face 12*b* of the housing.

In operation of the preloaded latches 50, TPA device 40 is mounted on connector housing 12 in a preloaded position as shown in FIG. 4. Latch arms 52 are molded integrally with housing 42 of the TPA device and are flexible in the direction of double-headed arrows "B". Upon preloading the TPA device, the latch arms flex outwardly until latch shoulders 58 on the latch arms snap behind latch shoulders 62 on connector housing 12. The TPA device will be held in this preloaded position by abutment of the distal ends of latch arms 52 with latch bosses 60 on the sides of the connector housing. When the terminals are fully inserted into the housing, TPA device 40 is pushed inwardly in the direction of arrow "C" such that latch arms 52 ride outwardly along chamfered forward ends 60*a* of latch bosses 60 until interior latch shoulders 56 of the latch arms snap behind latch shoulders 60*b* of the latch bosses to hold the TPA device in its fully mounted position on the connector housing, as shown in FIG. 3. In the fully mounted position, secondary locking portions or projections 46 are positioned between primary locking portions or latch flanges 36 of the terminals to prevent unlatching of the terminals as described above.

Figure 5:
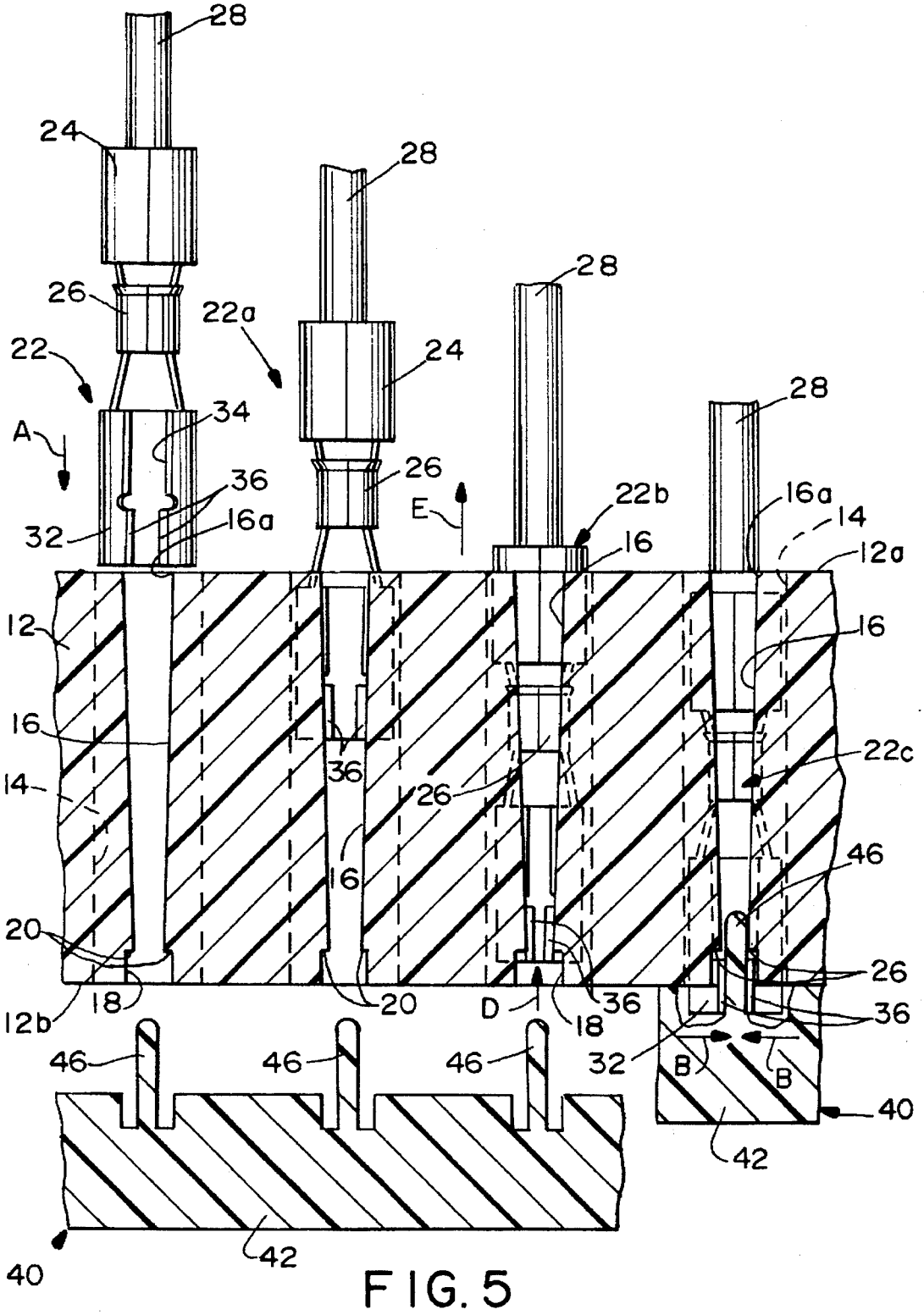
FIG. 5 is a horizontal section, on an enlarged scale, along four terminal-receiving passageways in the connector housing, and showing sequential positions of insertion of the terminals and the final position of the TPA device.

FIG. 5 shows four terminals 22, 22*a*, 22*b* and 22*c* in different sequential positions of insertion into their respective terminal-receiving passageways 14. The left-hand terminal 22 is shown just prior to insertion in the direction of arrow "A" into its respective passageway 14 at the left-hand end of housing 12. As the terminal enters the passageway, latch flanges 36 can easily enter groove 16 because the groove, at its mouth end 16*a*, is wider than the spacing of latch flanges 36.

Terminal 22*a* in FIG. 5 has been inserted partially into its passageway 14 to a point whereat latch flanges 36 of the terminal are engaging the side walls of diverging groove 16. However, the latch flanges have not as yet started to compress the mating portion of the terminal.

Terminal 22*b* in FIG. 5 has been inserted to an extent whereat latch flanges 36 are about to enter the abruptly enlarged latch section 18 at the latch end of diverging groove 16. In essence, the side walls of the groove have biased the latch flanges toward each other which results in compressing the cylindrical mating portion of the terminal to build up spring energy therein tending to bias the latch flanges back outwardly to their static condition.

Terminal 22*c* in FIG. 5 is shown in its fully inserted position within its respective passageway 14. It can be seen that the latch flanges 36 have snapped back outwardly into enlarged latch section 18, with the latch flanges positioned behind latch shoulders 20. In this fully inserted position, the terminal cannot be pulled back out of its passageway because of the latching of latch flanges 36 behind latch shoulders 20.

FIG. 5 shows how fully inserted terminal 22*c* projects beyond mating face 12*b* of housing 12. This affords access to latch flanges 36 by an appropriate tool, such as a pliers. If desired, the latch flanges can be moved toward each other in the direction of arrows "B" until the latch flanges can clear latch shoulders 20. Once clear of the shoulders, the terminal can be pulled back out of its passageway in a direction opposite the insertion direction.

Lastly, the right-hand portion of FIG. 5 shows how the secondary locking portion or projection 46 of TPA device 40 is received between primary locking portions or latch flanges 36 of terminal 22*c* to prevent inward flexing movement of the latch flanges and unlatching of the terminal. However, with respect to terminal 22*b*, it can be seen that the projection 46 of the TPA device 40 is in direct alignment with latch flanges 36 of the incompletely inserted terminal 22*b*, as indicated by arrow "D". Therefore, if one of the terminals are not fully inserted, as represented by terminal 22*b*, the respective secondary locking portion or projection 46 of TPA device 40 will contact the latch flanges 36 of the terminal and move the terminal rearwardly in the direction of arrow "E". Consequently, not only does the operation and function of the TPA system of the invention isolate incompletely inserted terminals, but the TPA device is effective to move the terminals rearwardly so that the incompletely inserted terminal(s) cannot be engaged or mated with the respective complementary terminal(s) of the mateable connecting device.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A terminal position assurance (TPA) system for an electrical connector comprising:

a dielectric housing having a forward mating end a rearward terminating end and at least one terminal-receiving passageway extending between the ends, the passageway including an enlarged latch section formed near the forward mating end of the housing;

a terminal insertable into the passageway from the rearward terminating end of the housing, the terminal having a mating portion adapted to mate with a complementary terminal inserted into the passageway from the forward mating end of the housing, and an outwardly extending primary locking portion adapted to latchingly engage the latch section of the passageway; and a TPA device engageable with the housing at the forward mating end thereof, the TPA device including a secondary locking portion positionable within said primary locking portion of the terminal to prevent movement of the primary locking portion away from latching engagement with the latch section of the passageway.

2. The terminal position assurance system of claim 1 wherein said TPA device includes a passage therethrough in alignment with the passageway in the housing for insertion therethrough of the complementary terminal of the mateable connecting device.

3. The terminal position assurance system of claim 1, wherein the TPA device includes latches engageable with latch shoulders on the housing for movement of the TPA device between a first preloaded position allowing latching between the primary locking portion and the latch section and a second locking position preventing movement of the primary locking portion away from the latch section.

4. The terminal position assurance system of claim 1 wherein said primary locking portion of the terminal projects beyond the forward mating end of the housing to provide access to the primary locking portion for unlatching the terminal from the latch section of the housing.

5. The terminal position assurance system of claim 4 wherein the passage in said TPA device includes an enlarged section for receiving the projecting primary locking portion of the terminal.

6. The terminal position assurance system of claim 1 wherein the mating portion of said terminal includes a longitudinal seam having one of said primary locking portions on each side of the seam.

7. The terminal position assurance system of claim 6 wherein the secondary locking portion of said TPA device is sized and configured for being received between the primary locking portions of the terminal to prevent transverse flexing thereof.

8. The terminal position assurance system of claim 1 wherein the primary locking portion of said terminal is movable between a first position in engagement with the latch section of the terminal-receiving passageways of the housing when the terminal is fully inserted and a second position of incomplete insertion of the terminal wherein the primary locking portion is rearward of the latch section, the secondary locking portion of the TPA device adapted to come in contact with the primary locking portion of the terminal in its second position to move the terminal rearwardly and detect incomplete insertion of the terminal.

9. A terminal position assurance (TPA) system characterized by:

an electrical connector including a dielectric housing having at least one terminal-receiving passageway with a latch section formed therein; and a terminal insertable into one end of the passageway and having a primary locking portion adapted to latchingly engage the latch section of the passageway, the primary locking portion being movable between a first position engaging the latch section and a second position of incomplete insertion of the terminal; and a TPA device engageable with the housing and including a secondary locking portion insertable in an opposite end of the passageway to prevent movement of the primary locking portion away from the latch section of the passageway, when the primary locking portion is in its first position, the secondary locking portion being adapted to come in contact with the primary locking portion of the terminal in its second position to move the terminal back toward the one end of the passageway.

10. The terminal position assurance system of claim 9 wherein said TPA device includes a passage therethrough in alignment with the passageway of the housing for insertion therethrough of a complementary terminal of a mateable connecting device.

11. The terminal position assurance system of claim 9, further characterized by complementary interengaging preload latches on the TPA device for mounting the TPA device to the housing wherein the TPA device moves relative to the housing between a first position allowing latching between the primary locking portion and the latch section and a second position preventing unlatching of the primary locking portion from the latch section.

12. The terminal position assurance system of claim 9 wherein said primary locking portion of the terminal projects beyond a forward mating end of the housing to provide access to the primary locking portion for unlatching the terminal.

13. The terminal position assurance system of claim 12 wherein the passage in said TPA device includes an enlarged section for receiving the projecting primary locking portion.

14. The terminal position assurance system of claim 9 wherein said terminal includes a mating portion having a seam with one of said primary locking portions on each side of the seam, the seam adapted to provide transverse flexibility between the primary locking portions.

15. The terminal position assurance system of claim 14 wherein the secondary locking portion of said TPA device is sized and configured for being received between the primary locking portions to prevent transverse flexing thereof.

* * * * *